US011527185B2

(12) United States Patent
Han

(10) Patent No.: US 11,527,185 B2
(45) Date of Patent: Dec. 13, 2022

(54) DISPLAY PANEL DRIVING APPARATUS

(71) Applicant: SAMSUNG DISPLAY CO., LTD., Yongin-si (KR)

(72) Inventor: Ho-Seok Han, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/397,932

(22) Filed: Aug. 9, 2021

(65) Prior Publication Data

US 2021/0366333 A1 Nov. 25, 2021

Related U.S. Application Data

(63) Continuation of application No. 16/906,977, filed on Jun. 19, 2020, now Pat. No. 11,087,657, which is a (Continued)

(30) Foreign Application Priority Data

Mar. 11, 2016 (KR) ..... 10-2016-0029816

(51) Int. Cl.

| | |
|---|---|
| ***G09G 5/00*** | (2006.01) |
| ***G09G 3/00*** | (2006.01) |
| ***G09G 3/20*** | (2006.01) |

(52) U.S. Cl.

CPC ..... *G09G 3/006* (2013.01); *G09G 3/2092* (2013.01); *G09G 5/00* (2013.01); *G09G 5/006* (2013.01);

(Continued)

(58) Field of Classification Search

CPC .... G11C 19/184; G11C 19/28; G09G 3/2092; G09G 2330/021; G09G 5/00; G09G 3/36; G09G 3/30; G06F 3/038

See application file for complete search history.

(56) References Cited

U.S. PATENT DOCUMENTS 5,367,644 A 11/1994 Yokoyama et al.
2004/0243905 A1* 12/2004 Merritt ..... H04L 1/1614 714/758

(Continued)

FOREIGN PATENT DOCUMENTS

JP 2008-152022 A 7/2008
JP 2013-172334 A 9/2013

(Continued)

OTHER PUBLICATIONS

Yoav Lavi, VLSI Plus Ltd., Latest Developments in MIPI Specifications, ChipEx2014, Apr. 30, 2014.

(Continued)

*Primary Examiner* — Pegeman Karimi

(74) *Attorney, Agent, or Firm* — Lewis Roca Rothgerber Christie LLP

(57) ABSTRACT

A display panel driving apparatus includes an interface, a timing controller, a gate driver, and data driver. The interface includes a data determiner to determine whether or not input image data has a communication error and to process a packet of a data stream of the input image data, even though the input image data has the communication error. The timing controller receives the processed input image data from the interface and generates a data signal, a gate control signal, and a data control signal. The gate driver generates a gate signal based on the gate control signal. The data driver generates a data voltage based on the data control signal and the data signal.

10 Claims, 5 Drawing Sheets

Related U.S. Application Data continuation of application No. 15/454,510, filed on Mar. 9, 2017, now Pat. No. 10,692,410.

(52) U.S. Cl.
CPC ..... *G09G 2310/08* (2013.01); *G09G 2330/08* (2013.01); *G09G 2330/12* (2013.01); *G09G 2370/10* (2013.01)

(56) References Cited

U.S. PATENT DOCUMENTS

| | | | | |
|---|---|---|---|---|
| 2009/0183033 | A1 | 7/2009 | Ando | |
| 2009/0213042 | A1 | 8/2009 | Hagino et al. | |
| 2010/0150461 | A1 | 6/2010 | Iwami | |
| 2012/0026202 | A1* | 2/2012 | Maciesowicz | G06F 3/14 345/214 |
| 2012/0092694 | A1* | 4/2012 | Tsubota | H04L 12/50 358/1.14 |
| 2013/0044088 | A1 | 2/2013 | Chang-Chian et al. | |
| 2016/0307537 | A1 | 10/2016 | Park et al. | |
| 2018/0240397 | A1 | 8/2018 | Hara | |

FOREIGN PATENT DOCUMENTS

| | | | |
|---|---|---|---|
| KR | 10-2000-0032166 | A | 6/2000 |
| KR | 10-2009-0084465 | A | 8/2009 |
| KR | 10-2015-0055250 | A | 5/2015 |

OTHER PUBLICATIONS

MIPI Alliance Specification for D-PHY, Version 1.00.00—May 14, 2009, Board Approved Sep. 22, 2009.
MIPI Appliance Specification for Display Serial Interface, Version 1.02.000 rev. 0.07, Mar. 30, 2010.
Electronic Science, Agilent, Announces High-Performance Modular Bert Solution, Nov. 4, 2015 (with English translation).
Tektronix, Understanding and Performing MIPI M-PHY Physical and Protocol Layer Testing, Aug. 2012.

* cited by examiner

| ERP | ERS | ER |
|---|---|---|
| L | L | L |
| L | H | H |
| H | L | H |
| H | H | H |

DISPLAY PANEL DRIVING APPARATUS

CROSS-REFERENCE TO RELATED APPLICATIONS

This application is a continuation of U.S. patent application Ser. No. 16/906,977, filed Jun. 19, 2020, which is a continuation of U.S. patent application Ser. No. 15/454,510, filed Mar. 9, 2017, now U.S. Pat. No. 10,692,410, which claims priority to and the benefit of Korean Patent Application No. 10-2016-0029816, filed Mar. 11, 2016, the entire content of all of which is incorporated herein by reference.

BACKGROUND

1. Field

One or more embodiments herein relate to a display panel driving apparatus.

2. Description of the Related Art

Mobile industry processor interface ("MIPI") is an interface widely used for mobile apparatuses having a resolution of nHD (360*640) or higher. According to a specification of the MIPI, when a communication error occurs, a valid packet may not be processed and an error report for the last communication error is only printed. In addition, a communication error process for Full HD resolution or higher has not been sufficiently provided.

SUMMARY

In accordance with one or more embodiments, a display panel driving apparatus includes an interface including a data determiner to determine whether or not input image data has a communication error and to process a packet of a data stream of the input image data even though the input image data has the communication error; a timing controller to receive the processed input image data from the interface and to generate a data signal, a gate control signal, and a data control signal; a gate driver to generate a gate signal based on the gate control signal; and a data driver to generate a data voltage based on the data control signal and the data signal.

The data determiner may determine a validity of the packet of the data stream and process the valid packet of the data stream. The data determiner may process the packet when the input image data do not have the communication error, the data determiner may process the packet when the input image data has the communication error and a packet process enable signal has an activated status, and the data determiner may not process the packet when the input image data has the communication error and the packet process enable signal has a deactivated status. The data determiner may output an error report regardless of whether the packet is processed.

In accordance with one or more other embodiments, a display panel driving apparatus includes an interface including a data determiner to determine whether or not input image data has a communication error and an error accumulator to accumulate a number of the communication errors; a timing controller to receive the processed input image data from the interface and to generate a data signal, a gate control signal, and a data control signal; a gate driver to generate a gate signal based on the gate control signal; and a data driver to generate a data voltage based on the data control signal and the data signal.

The error accumulator may output the accumulated number of communication errors when a request for reading the accumulated number of the communication errors is received. The error accumulator may output the accumulated number of communication errors when a request for reading the accumulated number of the communication errors and a bus turn-around signal are received.

The interface may include a transmitter to selectively output an error report and the accumulated number of communication errors to an application processor. The transmitter may output the error report to the application processor when the request for reading the accumulated number of communication errors is not received, and the transmitter may output the accumulated number of communication errors to the application processor when the request for reading the accumulated number of communication errors is received. The data determiner may determine a plurality of kinds of the communication errors, and the error accumulator may accumulate the number of communication errors for each of the kinds of communication errors.

In accordance with one or more other embodiments, a display panel driving apparatus includes a first interface includes a first data determiner to receive first input image data corresponding to a first area of a display panel, to determine whether or not the first input image data has a first communication error to generate a first communication error signal, and to process the first input image data; a second interface includes a second data determiner to receive second input image data corresponding to a second area of the display panel, to determine whether or not the second input image data has a second communication error to generate a second communication error signal, and to process the second input image data; a timing controller to receive the processed first input image data from the first interface and the processed second input image data from the second interface and to generate a data signal, a gate control signal, and a data control signal; a gate driver to generate a gate signal based on the gate control signal; and a data driver to generate a data voltage based on the data control signal and the data signal.

The first data determiner may generate a third communication error signal based on the first communication error signal and the second communication error signal, and the third communication error signal may represent a communication error of at least one of the first interface or the second interface. When a flag of the first communication error signal is a deactivated status and a flag of the second communication error signal is a deactivated status, a flag of the third communication error signal may have a deactivated status. When the flag of the first communication error signal is the deactivated status and the flag of the second communication error signal is an activated status, the flag of the third communication error signal may have an activated status. When the flag of the first communication error signal is an activated status and the flag of the second communication error signal is the deactivated status L, the flag of the third communication error signal may have the activated status. When the flag of the first communication error signal is the activated status and the flag of the second communication error signal is the activated status, the flag of the third communication error signal may have the activated status.

The first interface may include a controller to receive an input control signal and to output the input control signal to the timing controller. After the third communication error signal is output, the controller may reset the first communication error signal of the first data determiner and the second communication error signal of the second data determiner. The first interface may include a transmitter to output the third communication error signal to an application processor, and the second interface may not include the transmitter to output the third communication error signal to the application processor.

At least one of the first interface or the second interface may process a packet of a data stream of the first input image data or the second input image data, even though the first input image data has the first communication error or the second input image data has the second communication error. At least one of the first interface or the second interface may include an error accumulator to accumulate a number of the first communication errors or the second communication errors.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
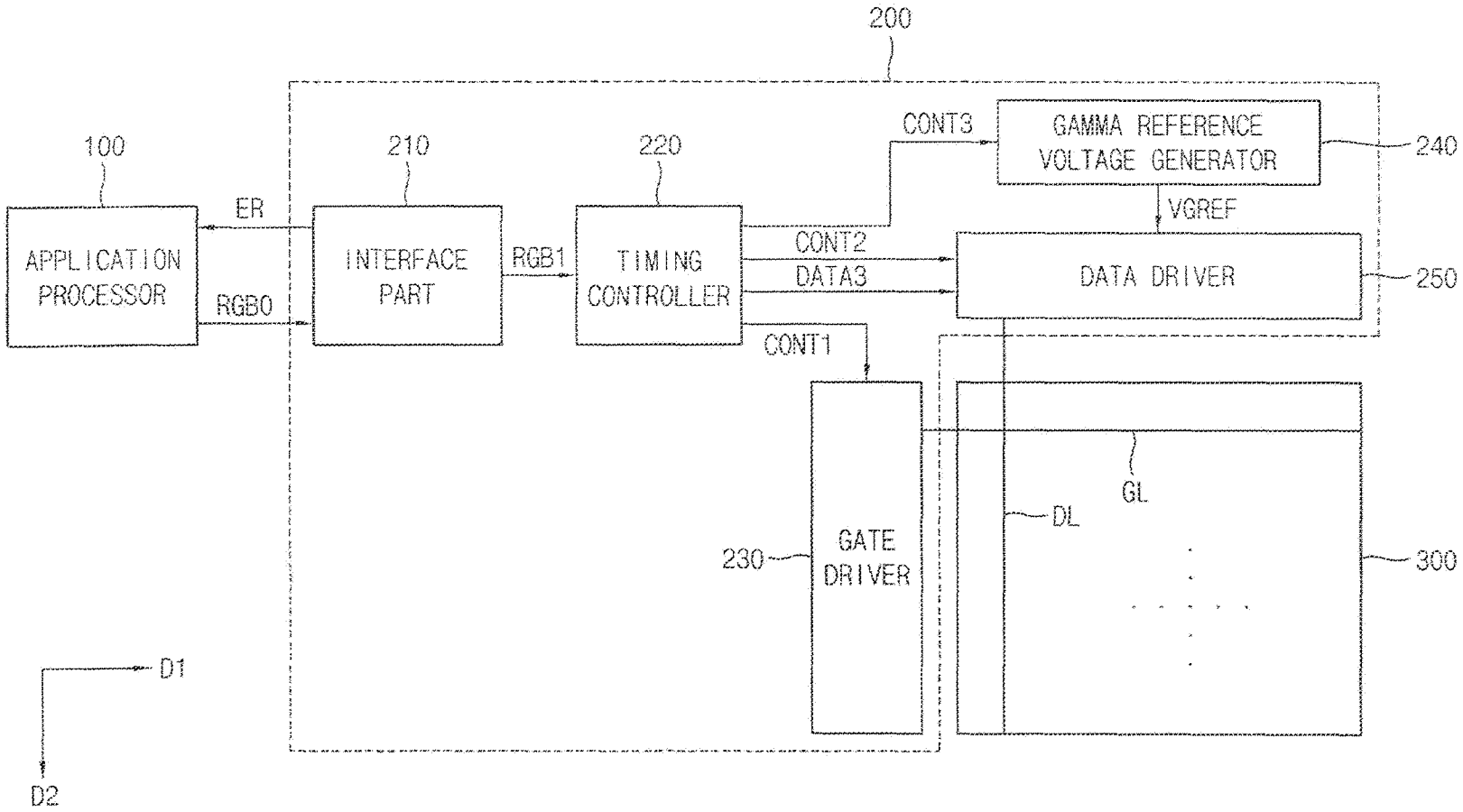
FIG. 1 illustrates an embodiment of a display apparatus.

Example embodiments are described with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments, or certain aspects thereof, may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of a display apparatus which includes an application processor 100, a display panel driving apparatus 200, and a display panel 300. The application processor 100 controls the display panel driving apparatus 200 so that the display panel 300 displays an image. The application processor 100 transmits input image data RGB0 to the display panel driving apparatus 200. The application processor 100 may transmit an input control signal to the display panel driving apparatus 200. The input control signal may include timing information of input image data RGB0.

The application processor 100 may be, for example, a central processing apparatus of an electronic apparatus which includes the display apparatus. For example, the application processor 100 may be a central processing part of a mobile apparatus. In one embodiment, the application processor 100 may be a set board of a television.

The display panel 300 has a display region on which an image is displayed and a peripheral region adjacent to the display region. The display panel 300 includes a plurality of gate lines GL, a plurality of data lines DL and a plurality of pixels connected to the gate lines GL and the data lines DL. The gate lines GL extend in a first direction D1 and the data lines DL extend in a second direction D2 crossing the first direction D1.

The display panel driving apparatus 200 includes an interface part 210, a timing controller 220, a gate driver 230, a gamma reference voltage generator 240 and a data driver 250. The interface part 210 receives the input image data RGB0. The interface part 210 processes a data stream of the input image data RGB0. The interface part 210 outputs the processed input image data RGB1 to the timing controller 220. For example, the input image data RGB0 input to the interface part 210 may have the same contents as the processed input image data RGB1 by the interface part 210, but may be of a type different from the processed input image data RGB1 by the interface part 210.

The timing controller 220 receives the processed input image data RGB1 from the interface part 210. The timing controller may receive the input control signal. The processed input image data RGB1 may include red image data R, green image data G, and blue image data B. The input control signal may include a master clock signal and a data enable signal. The input control signal may further include a vertical synchronizing signal and a horizontal synchronizing signal.

The timing controller 220 generates a first control signal CONT1, a second control signal CONT2, a third control signal CONT3, and a data signal DATA based on the processed input image data RGB1 and the input control signal. The timing controller 220 generates the first control signal CONT1 to control operation of the gate driver 230 based on the input control signal. The first control signal CONT1 is output to the gate driver 230. The first control signal CONT1 may further include a vertical start signal and a gate clock signal.

The timing controller 220 generates the second control signal CONT2 for controlling operation of the data driver 250 based on the input control signal, and outputs the second control signal CONT2 to the data driver 250. The second control signal CONT2 may include a horizontal start signal and a load signal.

The timing controller 220 generates the data signal DATA based on the processed input image data RGB1. The timing controller 220 outputs the data signal DATA to the data driver 250.

The timing controller 220 generates the third control signal CONT3 for controlling operation of the gamma reference voltage generator 240 based on the input control signal, and outputs the third control signal CONT3 to the gamma reference voltage generator 240.

The gate driver 230 generates gate signals driving the gate lines GL based on the first control signal CONT1 from timing controller 220. The gate driver 230 sequentially outputs the gate signals to the gate lines GL. The gate driver 230 may be directly mounted on the display panel 300 or may be connected to the display panel 300 as a tape carrier package ("TCP") type. In one embodiment, the gate driver 230 may be integrated on the display panel 300.

The gamma reference voltage generator 240 generates a gamma reference voltage VGREF based on the third control signal CONT3 from the timing controller 220. The gamma reference voltage generator 240 provides the gamma reference voltage VGREF to data driver 250. The gamma reference voltage VGREF has a value corresponding to a level of the data signal DATA. In an exemplary embodiment, gamma reference voltage generator 240 may be in the timing controller 220 or data driver 250.

The data driver 250 receives the second control signal CONT2 and the data signal DATA from the timing controller 220, and receives the gamma reference voltages VGREF from the gamma reference voltage generator 240. The data driver 250 converts the data signal DATA to data voltages having an analog type using the gamma reference voltages VGREF. The data driver 250 outputs the data voltages to the data lines DL. The data driver 250 may be directly mounted on the display panel 300 or may be connected to the display panel 300 in a TCP type. In one embodiment, the data driver 250 may be integrated on the display panel 300.

Figure 2:
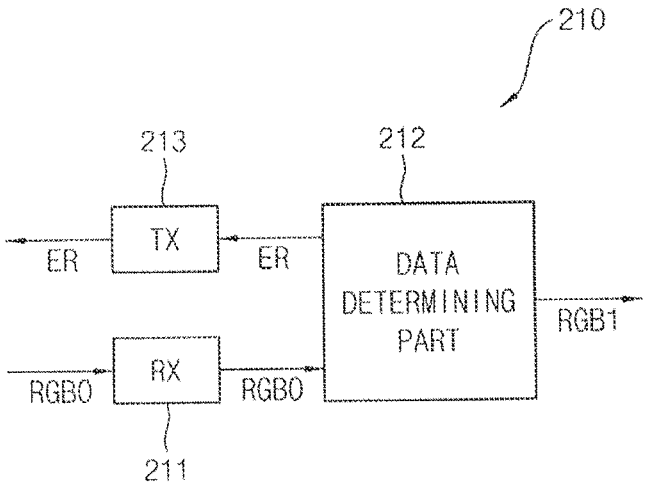
FIG. 2 illustrates an embodiment of an interface part.
Figure 3:
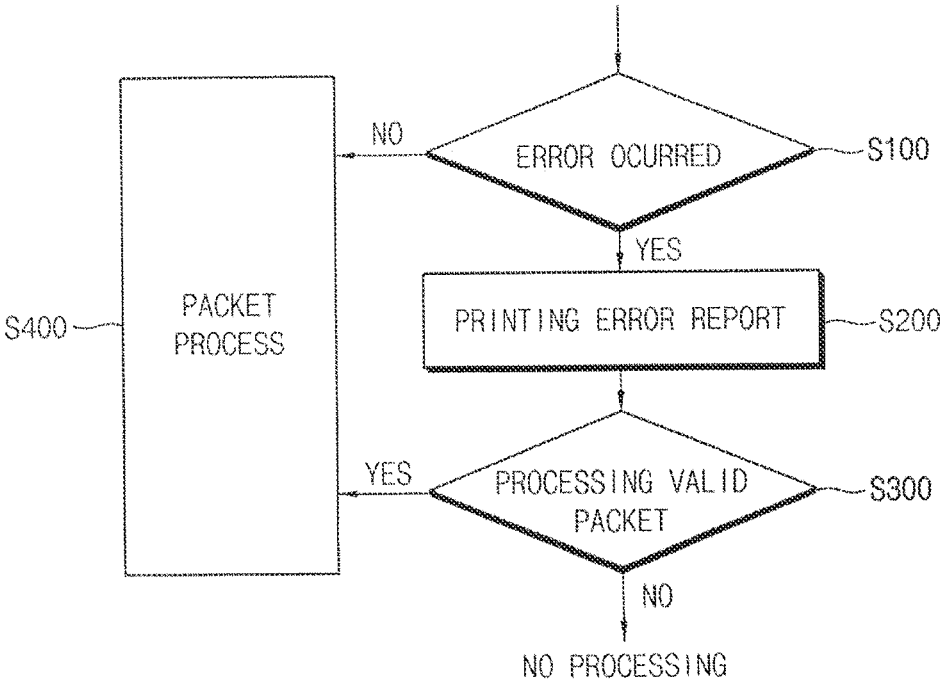
FIG. 3 illustrates an embodiment of an operation of a data determining part.

FIG. 2 illustrates an embodiment of the interface part 210 of FIG. 1, and FIG. 3 illustrates an embodiment of an operation of a data determining part 212 in FIG. 2.

Referring to FIGS. 1 to 3, the interface part 210 includes a receiver 211, the data determining part 212, and a transmitter 213. The interface part 210 supports the communication between the display panel driving apparatus 200 and the application processor 100. For example, the display panel driving apparatus 200 may communicate with the application processor 100 by MIPI. The receiver 211 receives the input image data RGB0 from the application processor 100 and transmits the input image data RGB0 to the data determining part 212.

The data determining part 212 processes the input image data RGB0 and outputs the processed input image data RGB1 to the timing controller 220. The data determining part 212 determines whether or not the received input image data RGB0 has a communication error. When the received input image data RGB0 has the communication error, the data determining part 212 generates an error signal ER and outputs the error signal ER to the transmitter 213.

The transmitter 213 outputs the error signal ER to the application processor 100.

The input image data RGB0 may include a data stream which includes a type of packet. For example, the data stream may include a type of {SoT, DATA ID, DATA0, DATA1, ECC, EoT}. In the data stream, {DATA ID, DATA0, DATA1, ECC} may be a packet header and SoT may be a start signal of the transmission, and DATA ID may be an identifier of the data. DATA ID may include a virtual channel identifier and data type information. Also, DATA0 and DATA1 are packet data. For example, the length of the packet data may be two bytes. ECC is an error correction code of the packet header. EoT is an end signal of the transmission.

The communication error may include SoT error, SoT sync error, EoT sync error, Bus Turn-Around ("BTA") timer time out error, ECC error, checksum error, invalid transmission length error, DSI protocol violation. BTA is a signal notifying an end of data transmission from a first agent to a second agent in the communication interface. When the BTA is received by the second agent, the second agent may notify the first agent, for example, for allowing subsequent data transmissions. DSI is an abbreviation of display serial interface.

The communication error may repetitively occur due to an error of the data type according to the application processor 100, even though the packet is valid. When the communication error occurs in a one type of communication interface, the packet is not processed regardless of the validity of the packet. As a result, the image is not displayed on display panel 300. For example, when the application processor 100 transmits valid packets but the type of EoT has an error, a DSI protocol violation may repetitively occur.

In the present exemplary embodiment, the data determining part 212 may process the packet of the data stream of the input image data RGB0 even though the communication error has occurred. In the present exemplary embodiment, when the communication error occurs, the data determining part 212 may determine the validity of the packet of the data stream and process the valid packet of the data stream.

In one embodiment, the data determining part 212 may determine processing the packet, or not, according to the communication errors without determining the validity of the packet. For example, the data determining part 212 may process the packet without determining the validity of the packet when a communication error not related to the packet data occurs. For example, the data determining part 212 may process the packet without determining the validity of the packet when one of an SoT error, EoT error, checksum error, or DSI protocol violation occurs.

The data determining part 212 determines that a communication error for the input image data RGB0 has occurred (Operation S100). When a communication error does not occur, the data determining part 212 processes the packet (Operation S400).

When a communication error occurs, the data determining part 212 outputs an error report to the transmitter 213 based on the error signal ER (Operation S200). The transmitter 213 outputs the error report to the application processor 100. For example, when a communication error occurs, the data determining part 212 may output the error report regardless of whether or not the packet is processed.

The data determining part 212 may process the packet, or not, according to a packet process enable signal. The data determining part 212 checks the status of the packet process enable signal (Operation S300).

When the packet process enable signal is activated, the data determining part 212 processes the valid packet despite the communication error (Operation S400). When the packet process enable signal is inactivated and a communication error occurs, the data determining part 212 does not process the packet (NO PROCESSING). When the packet process enable signal is inactivated and a communication error occurs, the data determining part 212 does not process the packet even though the valid packet exists.

In an exemplary embodiment, the packet process enable signal may be independently set according to communication errors. For example, the packet process enable signal may be activated for a DSI protocol violation, so that the valid packet may be processed even though a DSI protocol violation has occurred (Operation S400). For example, the packet process enable signal may be inactivated for a checksum error, so that the packet may not be processed when a DSI checksum error has occurred (NO PROCESSING).

According to the present exemplary embodiment, the interface part 210 of the display panel driving apparatus 200 may process the valid packet even when a communication error has occurred, so that reliability of the display panel 300 may be improved. Therefore, the communication interface between the display panel driving apparatus 200 and the application processor 100 may be improved, and display quality of the display panel 300 may be improved.

Figure 4:
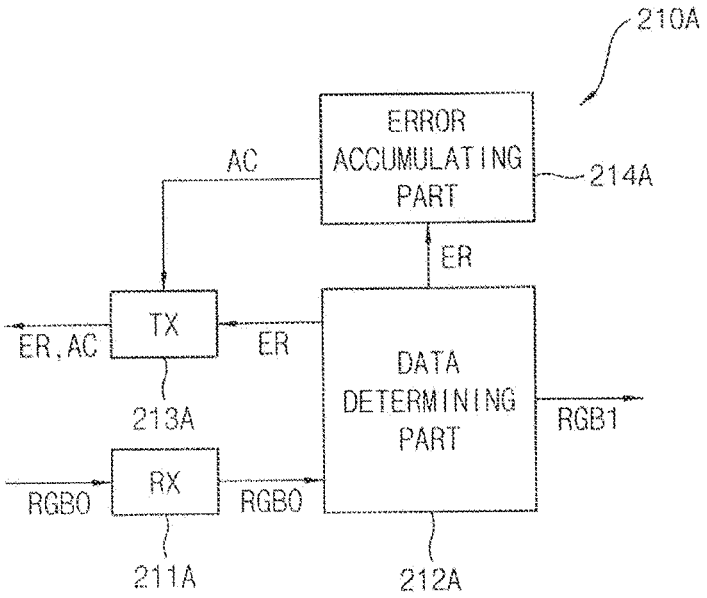
FIG. 4 illustrates an embodiment of an interface part of a display panel driver.
Figure 5:
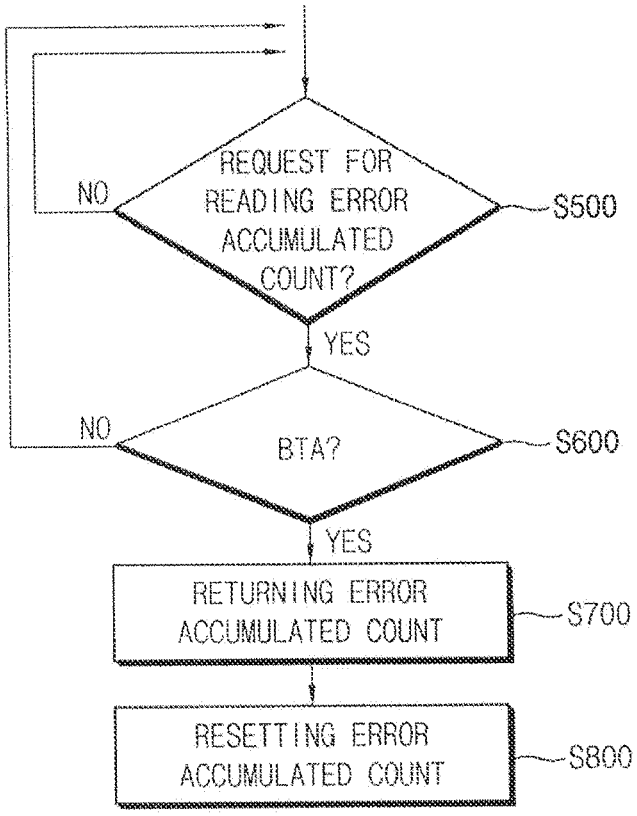
FIG. 5 illustrates an embodiment of an operation of a data determining part.

FIG. 4 illustrates an embodiment of an interface part 210A of a display panel driving apparatus. FIG. 5 illustrates an embodiment of an operation of a data determining part 212A of FIG. 4. The display panel driving apparatus may be substantially the same as the display panel driving apparatus in FIGS. 1 to 3, except for the interface part.

Referring to FIGS. 1, 4, and 5, the display apparatus includes an application processor 100, a display panel driving apparatus 200, and a display panel 300. The display panel driving apparatus 200 includes an interface part 210A, a timing controller 220, a gate driver 230, a gamma reference voltage generator 240 and a data driver 250.

The interface part 210A receives the input image data RGB0 and processes a data stream of the input image data RGB0. The interface part 210A outputs the processed input image data RGB1 to the timing controller 220.

The interface part 210A includes a receiver 211A, a data determining part 212A and a transmitter 213A and an error accumulating part 214A. The interface part 210A supports communication between the display panel driving apparatus 200 and the application processor 100. For example, the display panel driving apparatus 200 may communicate with the application processor 100 based on an MIPI specification.

The receiver 211A receives the input image data RGB0 from the application processor 100 and transmits the input image data RGB0 to data determining part 212A. The data determining part 212A processes the input image data RGB0 and outputs the processed input image data RGB1 to the timing controller 220.

The data determining part 212A determines whether the received input image data RGB0 has a communication error or not. When the received input image data RGB0 has a communication error, the data determining part 212A generates an error signal ER and outputs the error signal ER to the transmitter 213A.

The transmitter 213A outputs the error signal ER to application processor 100.

An error report output from one type of interface part may include the error occurrence, but may not include the number of times the error has occurred. Without this information, the application processor 100 may not perform proper actions for the errors.

In the present exemplary embodiment, the interface part 210A includes the error accumulating part 214A that accumulates the number of communication errors. The data determining part 212A outputs the error signal ER to the error accumulating part 214A. The error accumulating part 214A accumulates the number of the communication error based on the error signal ER.

When a request is received to read the accumulated count from the application processor 100, the error accumulating part 214A may output the accumulated count AC of the communication errors. A user may properly react to the communication errors based on the accumulated count AC of the communication errors. Thus, reliability of the display panel driving apparatus 200 may be improved.

For example, when an SoT sync error is rare, the user may improve the hardware design. However, when an SoT sync error is frequent, the user may improve the software.

For example, when the checksum error is rare, the user may ignore the checksum errors. However, when the checksum error is frequent, the user may improve the hardware design.

The accumulated count AC of the communication errors may be counted, for example, using the number of BTA signals. When the request for reading the accumulated count and the BTA signal are received, the error accumulating part 214A may output the accumulated count of the communication errors AC. When the request for reading the accumulated count is not received but the BTA signal is received, the interface part 210A may output the error report merely including the error occurrence.

The transmitter 213A may selectively output the error report and the accumulated count AC of the communication errors to the application processor 100. When the request for reading the accumulated count is not received, the transmitter 213A may output the error report to the application processor 100. When the request for reading the accumulated count is received, the transmitter 213A may output the accumulated count of the communication errors to the application processor 100.

The data determining part 212A may determine a plurality of kinds of communication errors. The error accumulating part 214A may accumulate the number of the communication errors for each kind of communication error. For example, the error accumulating part 214A may generate respective numbers of communication errors for the SoT error, the SoT sync error, the EoT sync error, the BTA timer time out, the ECC error, the checksum error, the invalid transmission length error, and the DSI protocol violation.

A process for outputting the accumulated count of the communication errors by the interface part 210A will now be described. The interface part 210A determines whether the request for reading the accumulated count is received from the application processor 100 (Operation S500). When the request for reading the accumulated count is not received, interface part 210A waits for the request for reading the accumulated count.

When the request for reading the accumulated count is received, the interface part 210A determines whether the BTA signal is received (Operation S600). When the BTA signal is not received, the interface part 210A waits for the BTA signal. When the request for reading the accumulated count and the BTA signal are received, the accumulated count of the communication errors is returned (Operation S700) and the accumulated count of the communication errors is reset (Operation S800).

According to the present exemplary embodiment, the interface part 210A of the display panel driving apparatus 200 includes the error accumulating part 214A, which accumulates communication errors, so that the number of the communication errors may be counted. The user may properly react to the communication errors based on the accumulated count of the communication errors. Thus, the interface between the display panel driving apparatus 200 and the application processor 100 may be improved and the display quality of the display panel 300 may be improved.

Figure 6:
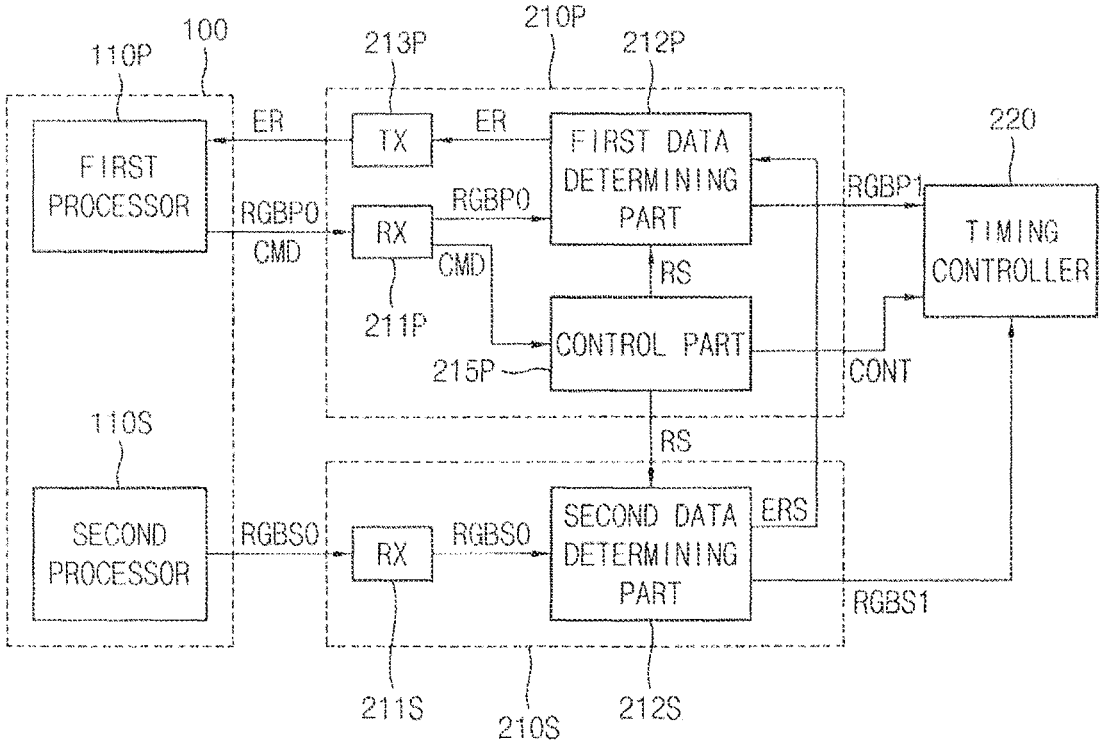
FIG. 6 illustrates another embodiment of a display apparatus.
Figures 7A, 7B:
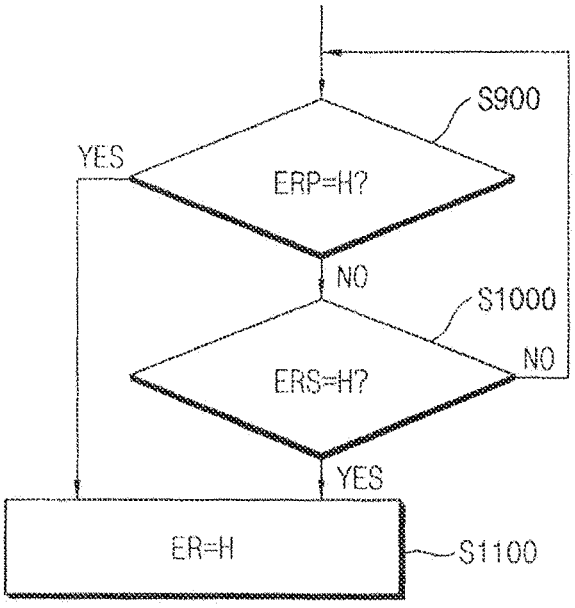
FIGS. 7A and 7B illustrate embodiments of an operation of a data determining part in FIG. 6.

FIG. 6 illustrates another embodiment of a display apparatus. FIG. 7A illustrates an embodiment of a table for the data determining part in FIG. 6. FIG. 7B illustrates an embodiment of an operation of the data determining part in FIG. 6. The display panel driving apparatus of this embodiment may be substantially the same as the display panel driving apparatus of FIGS. 1 to 3, except for the interface part.

Referring to FIGS. 1, 6, 7A and 7B, the display apparatus includes an application processor 100, a display panel driving apparatus 200, and a display panel 300. The display panel driving apparatus 200 includes an interface part 210P and 210S, a timing controller 220, a gate driver 230, a gamma reference voltage generator 240, and a data driver 250.

In one type of communication interface, the maximum number of data lanes is four and the data transmitting speed of the data lane is about 1 Gbps per lane. In this type of communication interface, a single communication interface part may not support high resolution, e.g., Full HD or WQHD.

In the present exemplary embodiment, the display panel driving apparatus 200 may include a first interface part 210P and a second interface part 210S. For example, the first interface part 210P may be a primary interface part and the second interface part 210S may be a sub interface part.

The first interface part 210P includes a first receiver 211P, a first data determining part 212P and a transmitter 213P. The first interface part 210P may further include a control part 215P receiving an input control signal CMD and outputting the input control signal CMD to the timing controller 220.

The first data determining part 212P receives first input image data RGBP0 corresponding to a first area of the display panel 300. The first data determining part 212P processes a data stream of the first input image data RGBP0 and outputs the processed first input image data RGBP1 to the timing controller 220. The first area of the display panel 300 may be, for example, a left half area of the display panel 300.

The first data determining part 212P may determine whether or not the received first input image data RGBP0 has a first communication error. The first data determining part 212P may generate a first communication error signal ERP.

The second interface part 210S includes a second receiver 211S and a second data determining part 212S. The second data determining part 212S receives second input image data RGBS0 corresponding to a second area of the display panel 300 and processes a data stream of the second input image data RGBS0. The second data determining part 212S outputs the processed second input image data RGBS1 to the timing controller 220. The second area of the display panel 300 may be, for example, a right half area of the display panel 300.

The second data determining part 212S may determine whether or not the received second input image data RGBS0 has a second communication error. The second data determining part 212S may generate a second communication error signal ERS and output the second communication error signal ERS to the first data determining part 212P of the first interface part 210P.

The first data determining part 212P may generate a third communication error signal ER based on the first communication error signal ERP and the second communication error signal ERS. The third communication error signal ER represents the communication error of at least one of the first interface part 210P and the second interface part 210S.

For example, when a flag of the first communication error signal ERP is a deactivated status L and a flag of the second communication error signal ERS is a deactivated status L, a flag of the third communication error signal ER may be a deactivated status L.

For example, when the flag of the first communication error signal ERP is the deactivated status L and the flag of the second communication error signal ERS is an activated status H, the flag of the third communication error signal ER may be an activated status H.

For example, when the flag of the first communication error signal ERP is an activated status H and the flag of the second communication error signal ERS is the deactivated status L, the flag of the third communication error signal ER may be the activated status H.

For example, when the flag of the first communication error signal ERP is the activated status H and the flag of the second communication error signal ERS is the activated status H, the flag of the third communication error signal ER may be the activated status H.

The table of FIG. 7A is obtained by the process of FIG. 7B. In FIG. 7B, it is determined whether or not the first communication error signal ERP has the activated status H (Operation S900). When the first communication error signal ERP has the activated status H, the third communication error signal ER has the activated status H regardless of the status of second communication error signal ERS (Operation S1100).

When the first communication error signal ERP has the deactivated status L, it is determined whether or not the second communication error signal ERP has the activated status H (Operation S1000). When the first communication error signal ERP has the deactivated status L and the second communication error signal ERS has the activated status H, the third communication error signal ER has the activated status H (Operation S1100). In contrast, when the first communication error signal ERP has the deactivated status L and the second communication error signal ERS has the deactivated status L, the third communication error signal ER does not output the activated status H.

The application processor 1000 may include a first processor 110P outputting the first input image data RGBP0 to the first interface part 210P and a second processor 110S outputting the second input image data RGBS0 to the second interface part 210S. In one embodiment, the application processor 100 may include a single processor outputting the first input image data RGBP0 to the first interface part 210P and the second input image data RGBS0 to the second interface part 210S.

After the third communication error signal ER is output to the application processor 100 or the first processor 110P, the control part 215P may output a reset signal RS to reset the first communication error signal ERP of the first data determining part 212P and the second communication error signal ERS of the second data determining part 212S to the first data determining part 212P and second data determining part 212S.

The first interface part 210P includes the transmitter 213P to output the third communication error signal ER to the application processor 100. The second interface 210S does not include the transmitter that outputs the third communication error signal ER to the application processor 100.

The display panel driving apparatus may include two interface parts in the present exemplary embodiment. In another embodiment, the display panel driving apparatus may include three, four, or more interface parts.

The exemplary embodiments explained referring to FIGS. 1 to 3 may be applied to the present exemplary embodiment. Similar to FIG. 2, at least one of the first interface part 210P and the second interface part 210S may process the data stream of the first input image data RGBP0 or the data stream of the second input image data RGBS0 when the first communication error ERP or the second communication error ERS occurs.

The exemplary embodiments explained referring to FIGS. 4 and 5 may be applied to the present exemplary embodiment. Similar to FIG. 4, at least one of the first interface part 210P or second interface part 210S may include the error accumulating part which counts the number of first communication errors or the number of second communication errors.

According to the present exemplary embodiment, the display panel driving apparatus may process communication errors ERP, ERS and ER between the interface parts 210P and 210S so that the high resolution of Full HD or above may be supported.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The accumulating, determining, and control parts, processors, controllers, drivers, generators, and other processing features of the disclosed embodiments may be implemented in logic which, for example, may include hardware, software, or both. When implemented at least partially in hardware, the accumulating, determining, and control parts, processors, controllers, drivers, generators, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the accumulating, determining, and control parts, processors, controllers, drivers, generators, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

In accordance with one or more of the aforementioned embodiments, a communication interface with an application processor may be improved and the display quality of the display panel may be improved.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A method of processing a data stream for a display apparatus, the method comprising:

determining whether or not input image data has a communication error;

outputting an error report when the input image data has the communication error; and processing a packet of the data stream of the input image data depending on a packet process enable signal, wherein the packet process enable signal is set according to a type of the communication error, and wherein valid packets of the data stream are not processed when the packet process enable signal is inactivated.

2. The method of claim 1, wherein the communication error includes at least one of SoT (start of transmission) error, SoT sync error, EoT (end of transmission) error, EoT sync error, Bus Turn-Around (BTA) timer time out error, ECC (error correction code) error, a checksum error, an invalid transmission length error, or DSI (display serial interface) protocol violation.

3. The method of claim 1, wherein the packet of the data stream of the input image data is processed when the packet process enable signal has an activated status.

4. The method of claim 1, wherein the packet of the data stream of the input image data is processed when it is determined that the communication error is unrelated to the packet.

5. The method of claim 4, wherein the packet of the data stream of the input image data is processed when the communication error is a checksum error, SoT (start of transmission) error or DSI (display serial interface) protocol violation.

6. The method of claim 1, further comprising determining validity of the packet of the data stream, wherein the packet of the data stream is processed when the packet process enable signal has an activated status and the packet is valid.

7. The method of claim 1, further comprising determining whether or not the communication error is related to the packet, wherein the packet of the data stream is processed without determining validity of the packet of the data stream when the packet process enable signal has an activated status and the communication error is unrelated to the packet.

8. The method of claim 1, wherein the packet process enable signal is inactivated for a checksum error.

9. A method of processing a data stream for a display apparatus, the method comprising:

determining whether or not input image data has a communication error;

outputting an error report when the input image data has the communication error; and processing a packet of the data stream of the input image data depending on a packet process enable signal that is set according to a type of the communication error, wherein the packet of the data stream of the input image data is processed when it is determined that the communication error is unrelated to the packet, and wherein the packet of the data stream of the input image data is processed when the communication error is EoT (end of transmission) error.

10. A method of processing a data stream for a display apparatus, the method comprising:

determining whether or not input image data has a communication error;

outputting an error report when the input image data has the communication error; and processing a packet of the data stream of the input image data depending on a packet process enable signal, wherein the packet process enable signal is set according to a type of the communication error, and wherein the packet process enable signal is activated for DSI (display serial interface) protocol violation.

* * * * *